US006209772B1

(12) United States Patent
Wang

(10) Patent No.: US 6,209,772 B1
(45) Date of Patent: Apr. 3, 2001

(54) STRUCTURE OF THE STAPLER

(76) Inventor: Deng-Fuw Wang, No, 306, Sec. 1, Wen Hua Rd., Pan Chiao City, Taipei Hsien (TW)

( * ) Notice: Subject to any disclaimer, the term of this patent is extended or adjusted under 35 U.S.C. 154(b) by 0 days.

(21) Appl. No.: 09/391,891

(22) Filed: Sep. 7, 1999

(51) Int. Cl.[7] ..... B25C 5/02
(52) U.S. Cl. ..... 227/134; 227/119; 227/120
(58) Field of Search ..... 227/134, 120, 227/123, 119, 109, 132

(56) References Cited

U.S. PATENT DOCUMENTS

| | | | | |
|---|---|---|---|---|
| 2,625,681 | * | 1/1953 | Boroughs | 227/134 |
| 2,726,393 | * | 12/1955 | Vogel | 227/134 |
| 3,076,195 | * | 2/1963 | Jopp | 227/123 |
| 4,463,890 | * | 8/1984 | Ruskin | 227/120 |
| 4,506,819 | * | 3/1985 | Rand | 227/120 |
| 4,650,105 | * | 3/1987 | Yoshio | 227/120 |
| 4,715,522 | * | 12/1987 | Jordan | 227/120 |
| 5,038,992 | * | 8/1991 | Shiang et al. | 227/120 |
| 5,421,502 | * | 6/1995 | Huang | 227/134 |
| 5,441,191 | * | 8/1995 | Linden | 227/120 |
| 5,507,425 | * | 4/1996 | Ziglioli | 227/120 |
| 5,992,724 | * | 11/1999 | Snyder | 227/120 |

* cited by examiner

*Primary Examiner*—Peter Vo
*Assistant Examiner*—Jim Calve
(74) *Attorney, Agent, or Firm*—Raymond Y. Chan; David and Raymond

(57) ABSTRACT

The invention is an improved structure of the stapler which consists of a pressing cover with a pressing plate and a protection plate underneath its front end and a base with a staple board in the front. The staple casket accommodates a pushing block which pushes the staples in the staple casket by the stretch of the spring behind it. The binding is completed by the pressing of the pressing plate and the guidance of the protection plate. A clasping part can be installed on the pushing block to hold an indicator for indicating the amount of the staples. A hook at the bottom of the casket deck hooks to the opening on the staple casket, so that when the staples run out the staple casket will slide out for reloading by the pressing of the pushing block. The staple board has a concave groove of a proper height and a spring plate is placed above it for guiding the staples when binding a thick pile of papers.

5 Claims, 7 Drawing Sheets

STRUCTURE OF THE STAPLER

BACKGROUND OF THE INVENTION

1. Field of the Invention

The present invention relates to an improved structure of the stapler and, in particular, to an improved structure of the stapler with the functions of protecting staples, automatically dismissing staples, indicating the amount of staples and guiding staples.

2. Description of the Prior Art

Since the successful invention of the stapler, it has become an indispensable tool for paper binding or packaging. Nonetheless, most of the conventional staplers have the following drawbacks:

1. The staples are easy to be tilted when piercing into paper. This prevents the staples from properly clasping the paper, which results in weaker binding and worse appearance.
2. The user could not know that the staples are running out without opening the stapler. And the pressing cover has to be opened when reloading staples.
3. When binding a thick pile of paper, the legs of the staple are often not long enough to clasping the paper.

In observation of the many drawbacks of the staplers of prior art, which is not a perfect design and needs modification, the inventor conquered the above mentioned disadvantages and finally presented this improved structure of the stapler after many years of research and hardworking.

SUMMARY OF THE INVENTION

The present invention provides an improved structure of the stapler which comprises a pressing cover with a pressing plate and a protection plate under the front end, a casket deck containing a staple casket, and a base with a staple board in the front; wherein the staple casket contains a pushing block, that pushes the staples in the casket by a spring behind it, so that the staples can bind the paper via the pressing of the pressing plate and, with the guidance of the protection plate, pierce through the paper without tilt.

Furthermore, the invention provides an improved structure of the stapler which is equipped with a hook at the bottom of the casket deck and an opening at the front bottom of the staple casket. The staple casket is connected to the hook via the opening, and the hook will be disconnected from the opening by the pressing of the pushing block when staples run out so that the staple casket will, pushed by the spring behind it, automatically slide out of the stapler for reloading.

Yet, the invention provides an improved structure of the stapler which is equipped with a staple board of a proper height at the front end of the base that has a concave groove and a spring plate above the staple board so that a good guidance of the staple can be obtained when binding a pile of paper.

Moreover, the invention provides an improved structure of the stapler which contains a clasping part for the attachment of an indicator indicating the amount of the staples in the stapler.

The improved structure of the stapler with the above mentioned merits comprises a pressing cover with a pressing plate and a protection plate under the front end, a casket deck containing a staple casket, and a base with a staple board in the front; wherein the staple casket contains a pushing block, that pushes the staples in the casket by a spring behind it, so that the staples can bind the paper via the pressing of the pressing plate and, with the guidance of the protection plate, pierce through the paper without tilt. Furthermore, the stapler contains a hook at the bottom of the casket deck and an opening at the front bottom of the staple casket, wherein the staple casket is connected to the hook via the opening, and the hook will be disconnected from the opening by the pressing of the pushing block when staples run out so that the staple casket will, pushed by the spring behind it, automatically slide out of the stapler for reloading.

BRIEF DESCRIPTION OF THE DRAWINGS

The drawings disclose an illustrative embodiment of the present invention which serves to exemplify the various advantages and objects hereof, and are as follows.

MAIN SYMBOLS

| | | | |
|---|---|---|---|
| 1 | pressing cover | 11 | long board |
| 111 | pressing plate | 112 | pillar |
| 12 | spring plate | 121 | perpendicular surface |
| 122 | slit | 123 | protection plate |
| 13 | spring plate | 2 | casket deck |
| 212 | fixing hole | 23 | hook |
| 231 | switch | 24 | staple casket |
| 242 | slit | 243 | U-shape opening |
| 244 | rectangular opening | 245 | inflected surface |
| 246 | wing | 25 | first spring |
| 26 | pushing block | 261 | clasping part |
| 262 | bump | 27 | second spring |
| 28 | indicator | 29 | long cylinder |
| 3 | base | 30 | pulling spring |
| 31 | staple board | 311 | concave groove |
| 32 | long spring plate | 321 | aperture |
| 322 | long slit | 33 | fixing pillar |
| 34 | keyhole | 4 | cleat |
| 5 | staple | 5a | staple |
| 6 | paper | 7 | scissors holder |
| 71 | sliding track | 72 | long box |
| 8 | scissors holder | 81 | sliding track |
| 82 | long box | | |

DETAILED DESCRIPTION OF THE PREFERRED EMBODIMENT

Figure 1:
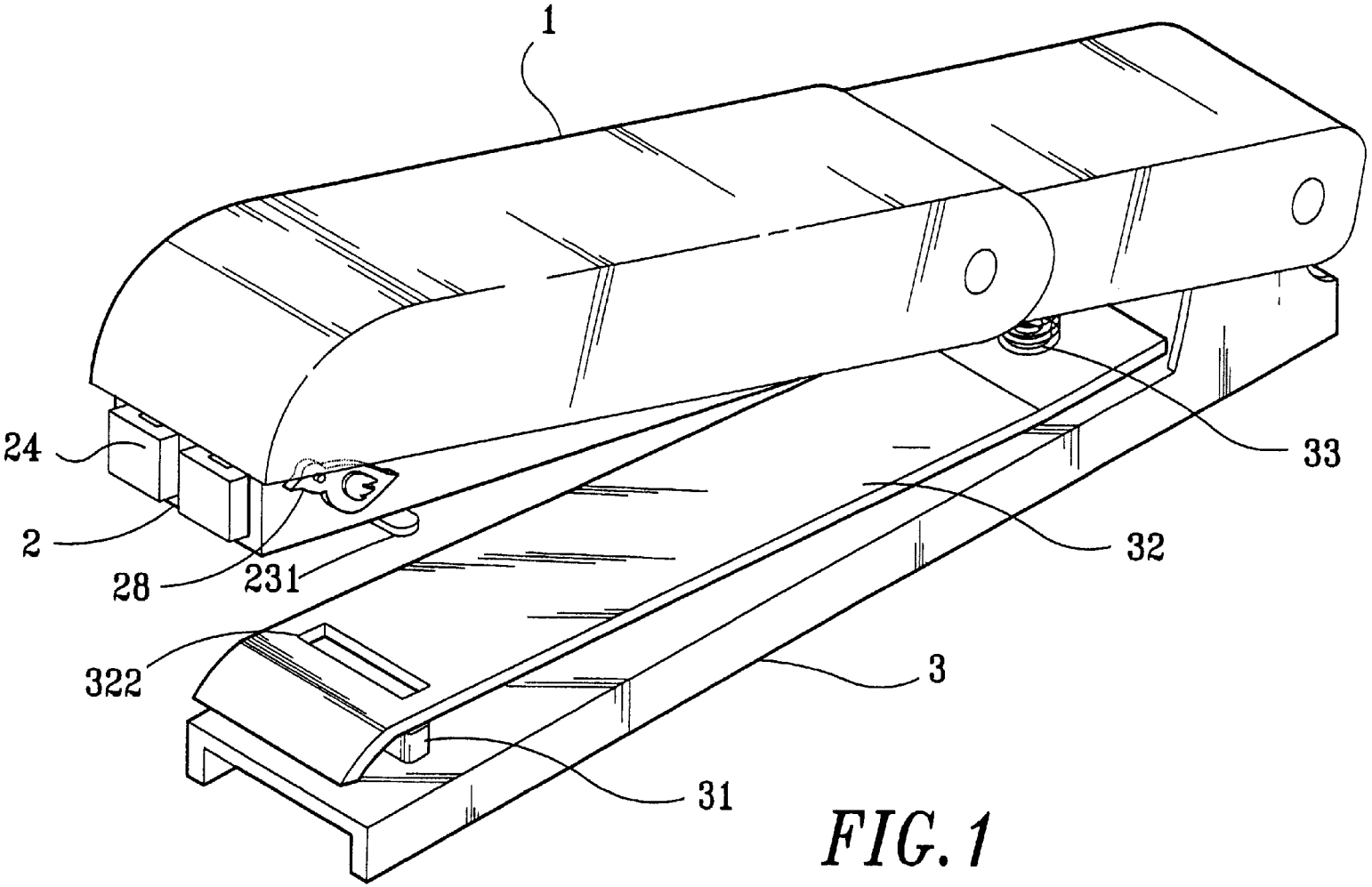
FIG. 1 is a three dimensional view of an improved structure of the stapler according to the invention.
Figure 2:
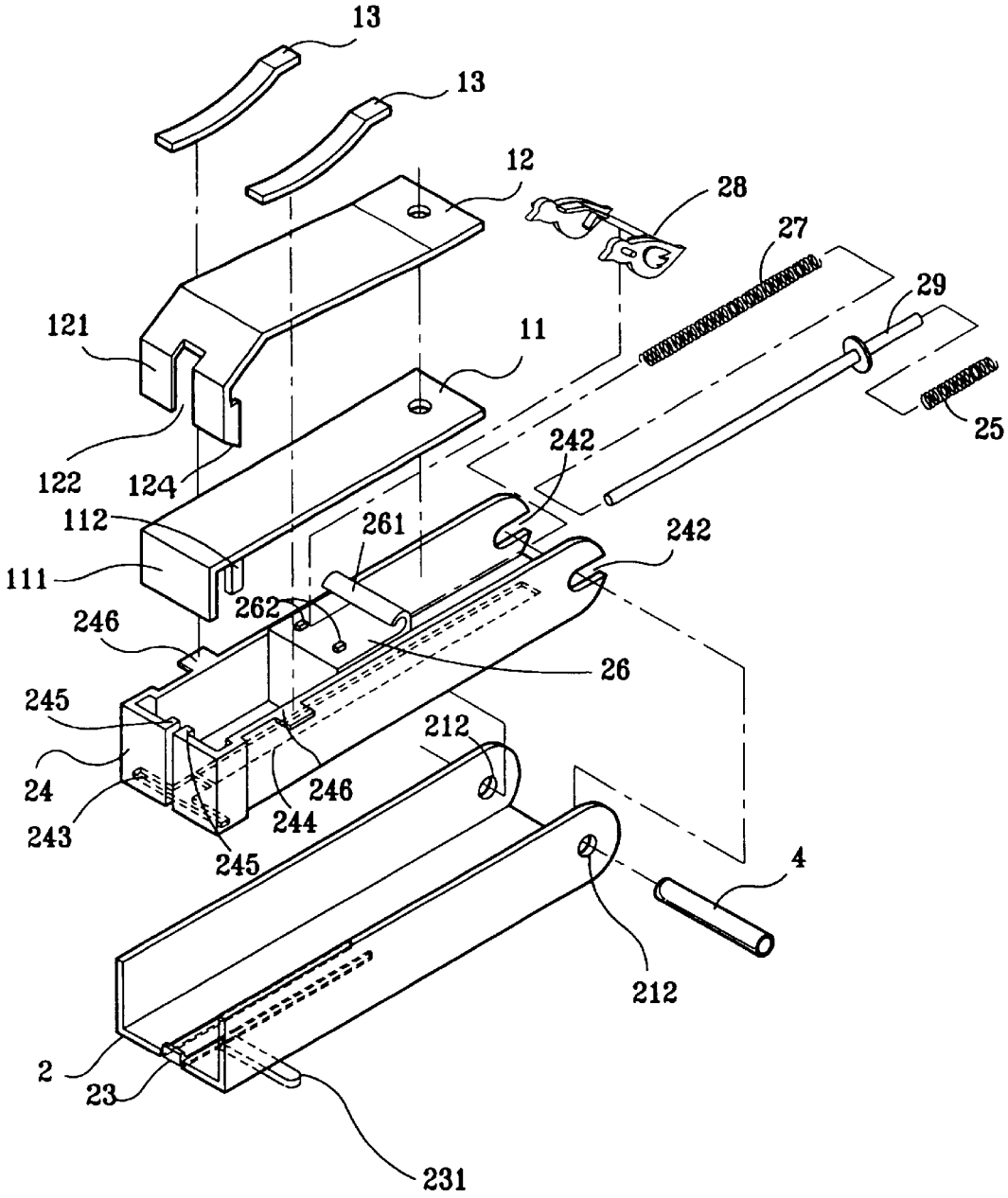
FIGS. 2 and 3 are three dimensional decomposition diagrams of an improved structure of the stapler according to the invention.
Figure 3:
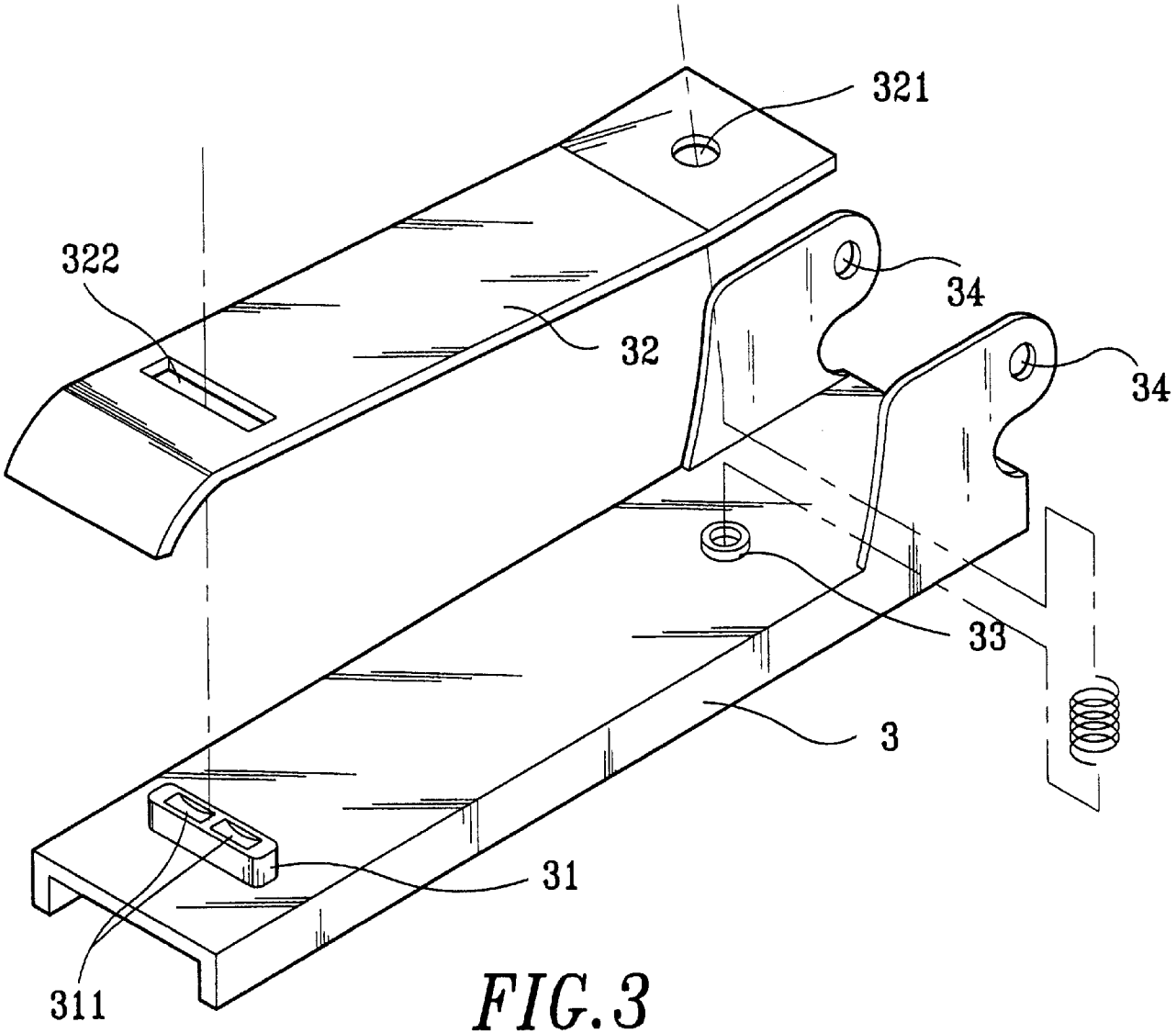

Please refer to FIGS. 1, 2 and 3. The instant invention comprises a pressing cover 1, a casket deck 2 and a base 3. The pressing cover 1 contains a long board 11 whose front end is bent downward perpendicularly to form a pressing plate 111 and a pair of pillars 112 is placed at a proper position behind the pressing plate 111. A spring plate 12 bent by a proper angle in the middle is placed above the long board 11 and the front end of the spring plate 12 is bent downward to form a perpendicular surface 121, where a slit 122 is opened at the center of the perpendicular surface 121 while both sides are bent inward with sharp tips 124 at the bottom of the bent surfaces to form a set of protection plates 123. When the spring plate 12 is placed on top of the long board 11, the protection plate 123 can coincide with the pressing plate 111 so that when the pressing cover is pressed downward the staple will be pushed out by the pressing plate 111 and guided by the protection plate 123.

The casket deck 2 is a U-shape deck. Its front extends a proper width sideways and a hook 23 is placed at a proper position in the middle. A staple casket is placed into the casket deck 2. The rear end of the staple casket 24 has a pair of slits 242 of a proper length, the front bottom has a U-shape opening 243 and a rectangular opening 244 at a proper position behind the U-shape opening 243. A first spring 25 supports at its rear end so that when the staple casket 24 is placed within the casket deck 2 the hook 23 can clasp the rectangular opening 244 and fix the staple casket 24. A pushing block 26 is placed within the staple casket 24, wherein the pushing block is pushed from behind by a second spring 27 around a long cylinder 29. The front top of the pushing block 26 has a pair of bumps 262 so that when the staples in the staple casket 24 run out and the pushing block slides to the front end of the staple casket 24, the pillars 112 on the long board 11 will press on the bumps 262 so that the pushing block 26 will be pushed toward the hook 23 and cause the separation between the hook 23 and the rectangular opening 244. The staple casket 24 will slide forward due to the stretch of the second spring 25 for reloading. A switch 231 is attached to the hook 23 under the casket deck 2 so that the user can reload the staples at any time by pressing the switch 231, resulting in the separation between the hook 23 and the rectangular opening 244. Also, a clasping part 261 is equipped on the pushing block 26 to hold an indicator 28 for indicating the amount of the staples within the stapler.

The base 3 has a staple board 31 in the front which has a symmetric concave groove 311 on the top surface of a proper height. A long spring plate bent by a proper angle is placed above the staple board 31. The long spring plate 32 is fixed by an aperture 321 at its rear end to the fixing pillar 33 at the rear end of the base 3. A long slit 322 is opened at its front end, matching the position of the staple board 31, so that when the tips of the staple will be bent inward when the user squeezes the stapler.

When combining the above mentioned elements, a cleat 4 is inserted through a pair of keyholes 34 at the rear end of the base 3 and a fixing hole 212 of the casket deck 2 to form a complete stapler. The staples are placed inside the staple casket 24 and are pushed to the front by the pushing block 26 so that, when the pressing cover 1 is pressed downward, the pressing plate 111 will push out the first staple which binds the paper with the help of the staple board 31. Furthermore, since the front end of the staple casket 24 is a pair of inflected surfaces 245 of a proper width, the staple can be separated from the front end by a certain distance for the protection plate to go through and guide the staple. The staple casket 24 has a pair of symmetric wings 246 on both sides in order that the spring plates 13 will press against the wings while the stapler is squeezed down and restore the whole casket deck to its original position after releasing.

Figure 4:
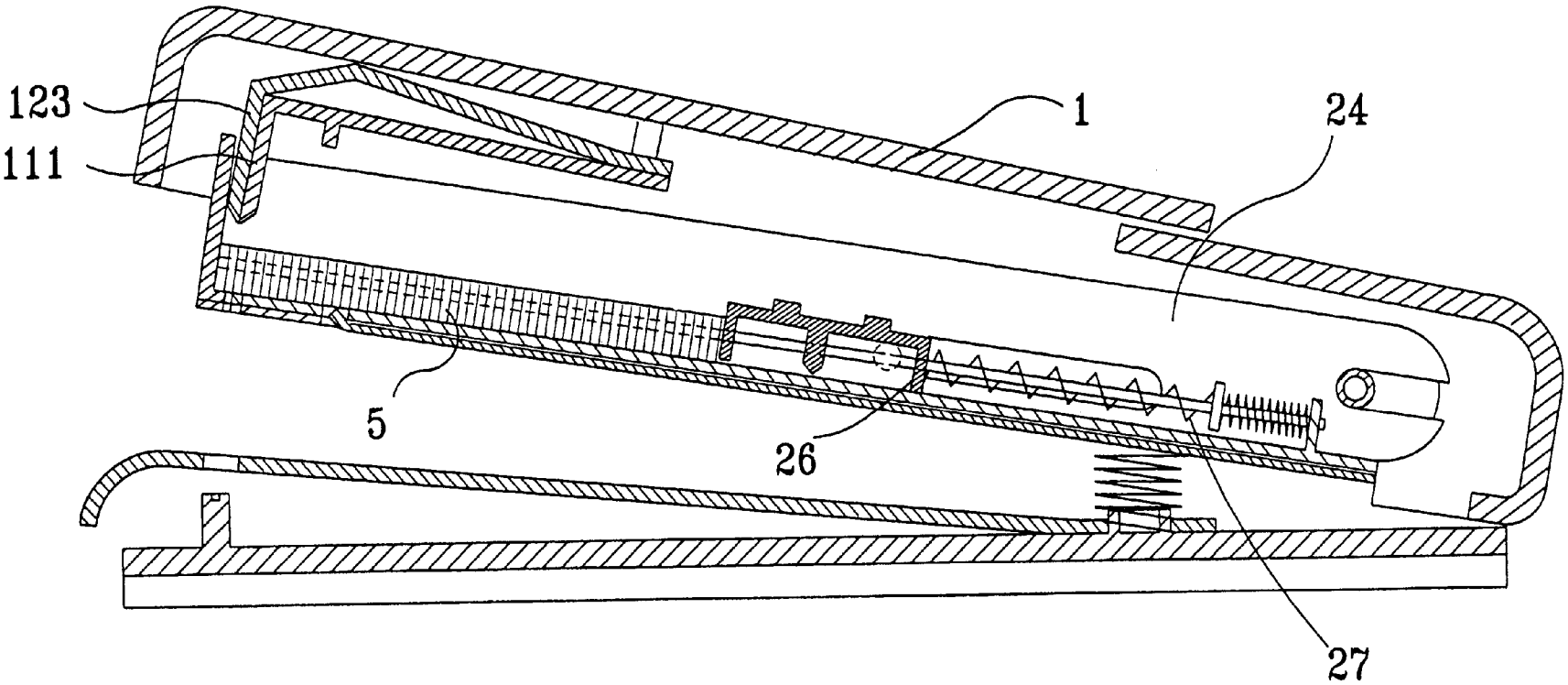
FIG. 4 is a cross section of an improved structure of the stapler according to the invention.

FIG. 4 shows that staples 5, placed within the staple casket 24, are pushed toward the front end of the staple casket 24 by the pushing block 26 due to the stretch of the second spring 27. The first staple keeps a proper distance from the front end of the staple casket 24. Therefore, when the pressing cover 1 is pressed downward, the protection plate 123, owing to its angle, first pass through this extra space, then the pressing plate pushes out the first staple. The protection plate guides the staple and prevents it from tilting, and thus completes the binding.

Figure 5A:
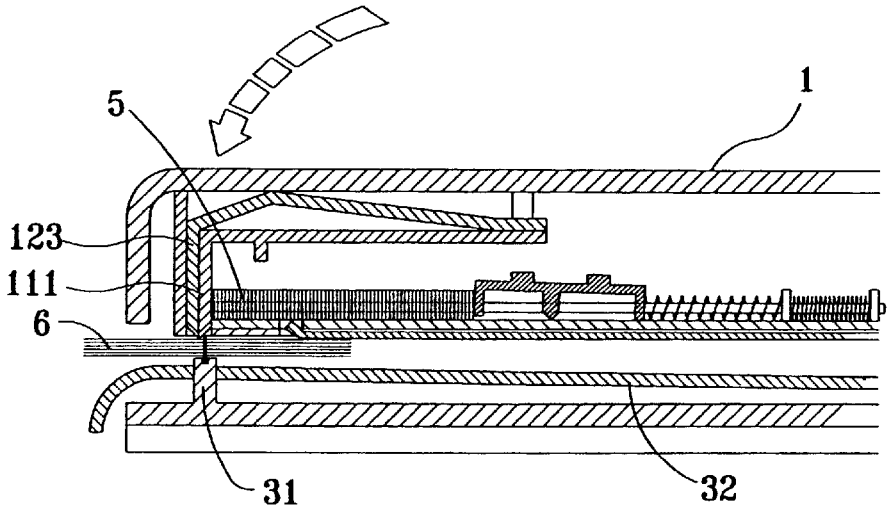
FIGS. 5A and 5B are an embodiment of the operation of an improved structure of the stapler according to the invention.

As shown in FIG. 5A, when the pressing cover 1 is pressed downward, the sharp part at the bottom of the protection plate 123 will first press the paper 6. Thus, when the first staple is pushed out by the pressing plate 111, it will not tilt because of the protection plate 123 around it. When there is too much paper or the pile is too thick, the part of the staple piercing out of the bottom of the paper would be too short. One can then increase the pressure upon the pressing cover 1, the spring plate 32 lowers further so that the staple board 31 will relatively stick out more to help bending the staple and obtaining a firm binding.

Figure 5B:
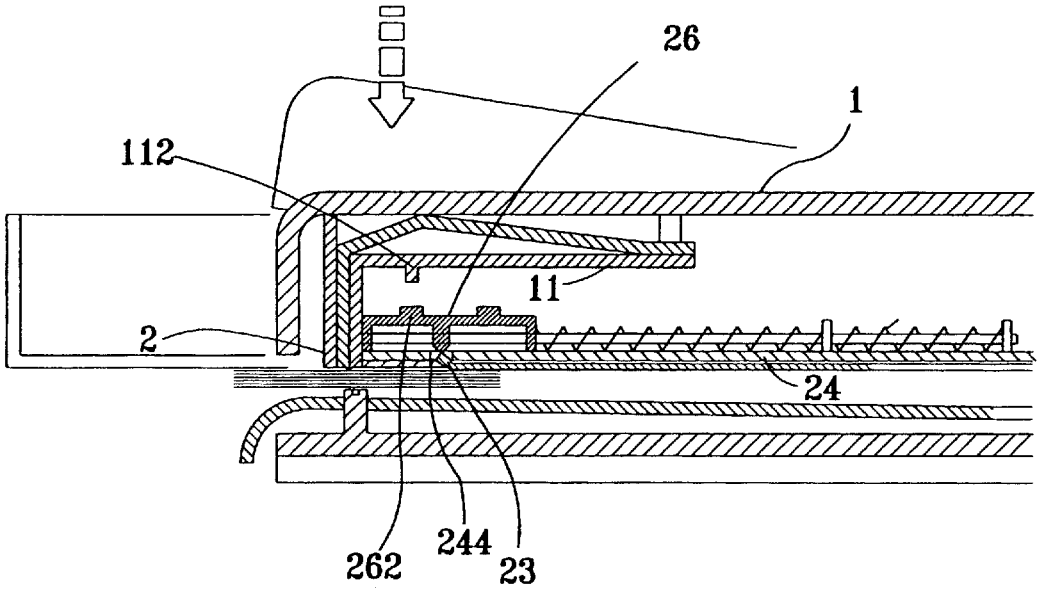

As shown in FIG. 5B, when the staples 5 run out, the pushing block 26 will slide to the front end of the staple casket 24. As one presses down the pressing cover 1, the pillars 112 on the front bottom surface of the long board 11 will touch the bumps 262 on the pushing block 26 and cause the separation between the hook 23 and the rectangular opening 244 on the staple casket 24. In this way, the staple casket 24 will slide out by the stretch of the second spring 27 for reloading when the pressing cover 1 is released.

Figure 6:
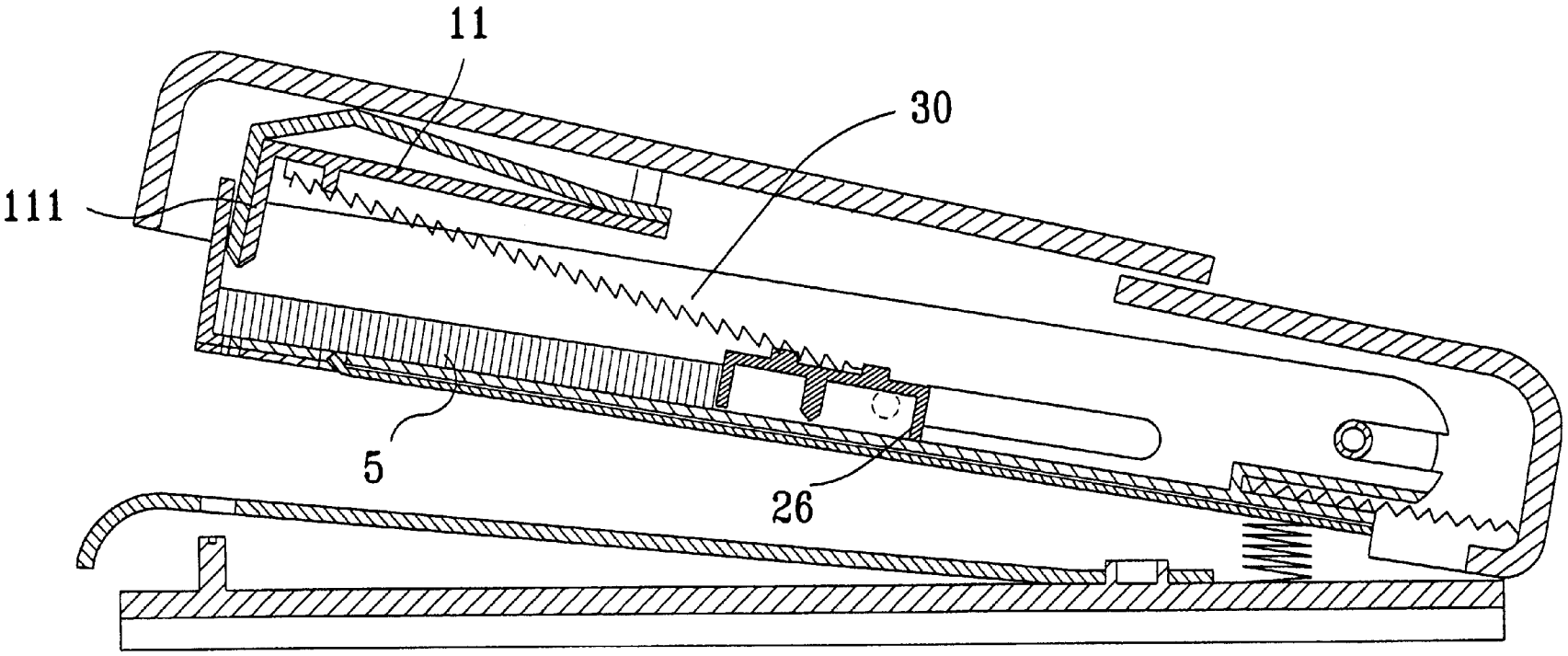
FIG. 6 is a cross section of the second embodiment of an improved structure of the stapler according to the invention.

Please refer to FIG. 6. The most significant difference between the second embodiment and the above mentioned embodiment is one the spring that pushes the pushing block 26 forward, which is replaced by a drawing spring 30. One end of the drawing spring 30 is fixed on the front end of the long board 11 and the other end is fixed on the pushing block 26. With the pulling of the drawing spring 30, the pushing block 26 can also achieve the goal of pushing the staples 5 to the front of the staple casket 24.

Figure 7:
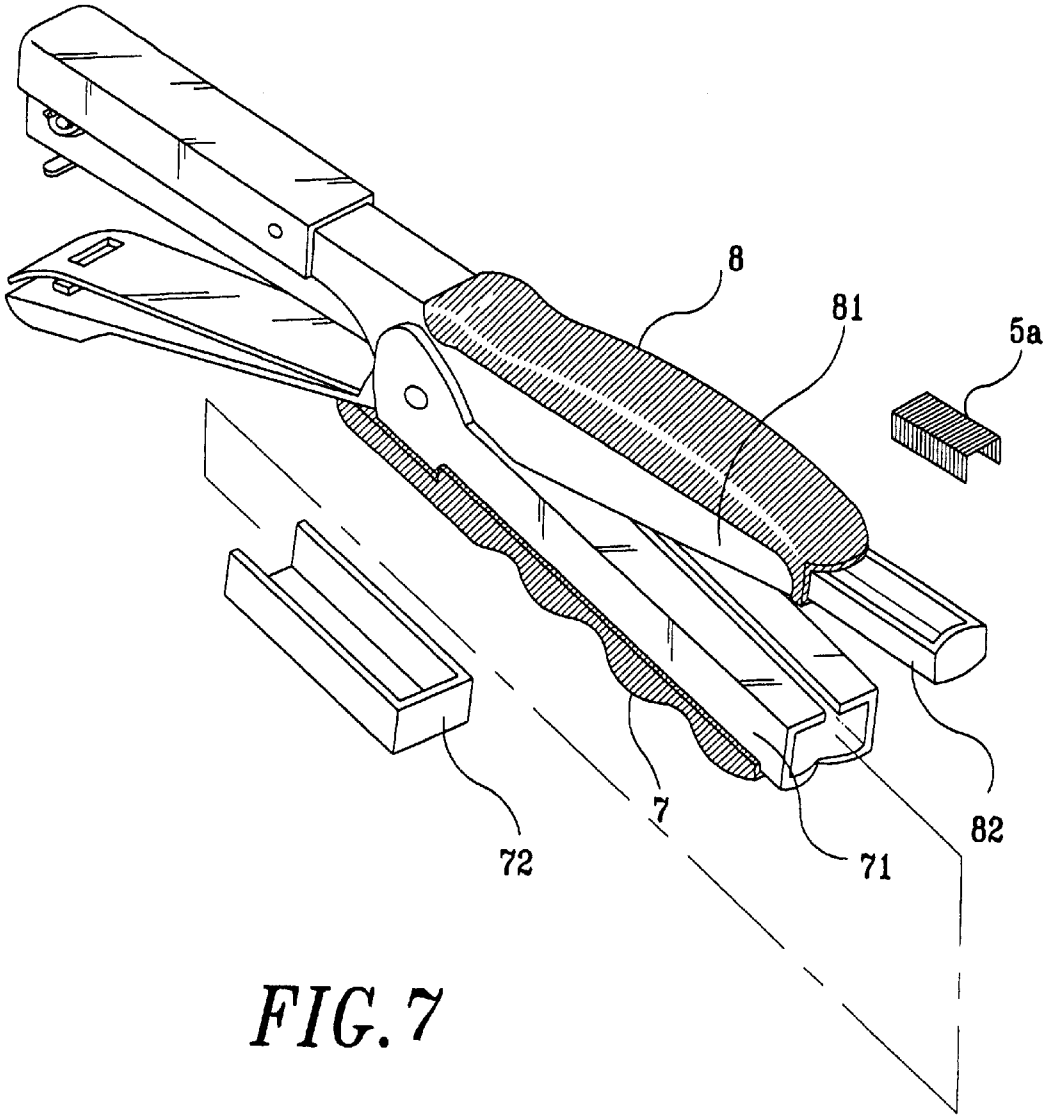
FIG. 7 is a diagram of the third embodiment of an improved structure of the stapler according to the invention.

Please refer to FIG. 7. The invention can be modified by extending the rear ends of both the pressing cover 1 and the base 3 to form a pair of scissors holders 7,8 for holding and squeezing. Furthermore, there are sliding tracks 71,81 in the holders 7,8 to accommodate long boxes 72,82 for storing spare staples 5*a*, respectively. One then only needs to squeeze the holders 7,8 to staple papers.

The improved structure of the staple according to the instant invention, compared with the prior art, has the following merits:

1. The bottom of the casket deck, according to the invention, has a hook that clasps an opening on the front bottom of the staple casket. When the staples run out, the staple casket will automatically slide out for reloading because of the separation of the hook from the opening caused by the pushing block. This makes the reloading process easier.
2. The clasping part on the pushing block, according to the invention, can hold an indicator for indicating the amount of the staples.
3. The protection plate, according to the invention, can prevent the staples from tilting and get a firm binding.
4. The front end of the base, according to the invention, contains a staple board with a concave groove at a proper height. There is a spring plate above the staple board for guiding the staple when binding a think pile of papers.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved structure of the stapler, which comprises:

a pressing cover, wherein said pressing cover has a long board, a front end being bent perpendicularly downward to form a pressing plate and a pair of pillars placed at a proper position behind said pressing plate, a spring plate bent at a proper angle is above said long board with the front end of the spring plate being bent downward to form a perpendicular surface, which has a slit in the middle and inwardly inflected surfaces with acute tips on the bottom on both sides of said slit and constitutes a protection plate in such a manner that said protection plate sticks by said pressing plate when said spring plate is placed on top of said long board;

a casket deck, which is a U-shape deck with a pair of keyholes near the rear end and a hook at a proper position in the middle of the front end;

a staple casket, which is inserted within said casket deck with a pair of slits of a proper length at the rear end, a U-shape opening at the front bottom, a rectangular opening at a proper position behind said U-shape opening, and a first spring at the rear bottom;

a pushing block, which, with symmetric bumps and a clasping part on the top, is placed within said staple casket and is connected from the rear end to a long cylinder with a second spring around the cylinder for pushing said pushing block forward; and a base, wherein said base has a staple board of a proper height which has a symmetric concave groove on the top surface and a long spring plate bent at a proper angle is placed above said staple board with a long slit at the front end for said staple board going through;

wherein when said pressing cover is pressed downward, said pressing plate will push out a first of a plurality of staples in said staple casket to bind the paper without tilting with the help of said staple board; when said staples run out, said pushing block slides to the front end of said staple casket so that said pair of pillars on said long board touch said bumps on said pushing block and press down said pushing block and cause the separation between said hook and said rectangular opening on said staple casket for said staple casket to slide out in a forward direction for reloading by the stretch of said second spring.

2. An improved structure of the stapler as of claim 1, wherein said clasping part holds an indicator for indicating the amount of said staples in said stapler.

3. An improved structure of the stapler as of claim 1, wherein said staple casket has a pair of inward inflected surfaces of a proper width in the middle of said front perpendicular surface to allow said protection plate to pass.

4. An improved structure of the stapler as of claim 1, wherein a switch is installed on said hook to allow the user to reload the staples at any time by pressing down said switch, which causes the separation between said hook and said rectangular opening on said staple casket for said staple casket to slide out in the forward direction for reloading by the stretch of said second spring.

5. An improved structure of the stapler as of claim 1, wherein said second spring can be replaced by a drawing spring.

* * * * *